US012618176B1

(12) United States Patent
Rajput et al.

(10) Patent No.: US 12,618,176 B1
(45) Date of Patent: May 5, 2026

(54) INTERLACED GEOTEXTILE FABRIC

(71) Applicant: PBR INC., Athens, GA (US)

(72) Inventors: Vishav Rajput, Dist Kutch (IN); Vijay Patel, Ahmedabad (IN); Anurag Shah, Athens, GA (US)

(73) Assignee: PBR INC., Athens, GA (US)

( * ) Notice: Subject to any disclaimer, the term of this patent is extended or adjusted under 35 U.S.C. 154(b) by 0 days.

(21) Appl. No.: 19/014,747

(22) Filed: Jan. 9, 2025

(51) Int. Cl.
*D03D 15/00* (2021.01)
*D03D 15/283* (2021.01)
*D03D 15/46* (2021.01)
*D03D 1/00* (2006.01)

(52) U.S. Cl.
CPC ..... *D03D 15/46* (2021.01); *D03D 15/283* (2021.01); *D10B 2321/021* (2013.01); *D10B 2321/022* (2013.01); *D10B 2401/063* (2013.01); *D10B 2505/204* (2013.01)

(58) Field of Classification Search
CPC ..... D03D 15/46; D03D 15/283; D10B 2321/021; D10B 2321/022; D10B 2401/063; D10B 2505/204
See application file for complete search history.

(56) References Cited

U.S. PATENT DOCUMENTS 4,460,023 A * 7/1984 Mullaney ..... D21F 1/0036 162/902
5,655,585 A * 8/1997 Fry ..... E06B 9/13 160/DIG. 7
5,927,222 A * 7/1999 Eakin ..... B63C 1/02 114/45
7,207,747 B1 * 4/2007 England ..... E02B 11/005 210/170.03
7,465,129 B2 * 12/2008 Singleton ..... E02D 17/20 428/221
8,092,896 B2 * 1/2012 Erez ..... E02D 17/202 428/116
8,333,220 B2 * 12/2012 King ..... D03D 15/46 139/408
8,598,054 B2 * 12/2013 King ..... D03D 11/00 442/205
9,297,134 B1 * 3/2016 Dancer ..... E02B 3/12
9,404,233 B2 * 8/2016 Jones ..... D03D 9/00
10,829,873 B2 * 11/2020 Jones ..... D03D 15/44
(Continued)

FOREIGN PATENT DOCUMENTS

MY 180168 * 11/2020 ..... D03D 15/573

OTHER PUBLICATIONS

International Search Report (ISR) from International Application No. PCT/IB2025/053833; mailed on Jul. 10, 2025; 4 pages.
(Continued)

*Primary Examiner* — Robert H Muromoto, Jr.
(74) *Attorney, Agent, or Firm* — Jason A. Smith; Shumaker, Loop & Kendrick, LLP

(57) ABSTRACT

An interlaced geotextile fabric obtained by inter-weaving at least one set of a warp yarn and at least one set of a weft yarn. More specifically, the interlaced geotextile fabric has an unbalanced twill weave pattern, which is suitably used for soil stabilization. The distinct physical characteristics, size, and denier disparity between weft yarns of the fabric promote hydraulic properties and minimize apparent opening size while offering a stable and durable product upon installation.

19 Claims, 3 Drawing Sheets

(56) References Cited

U.S. PATENT DOCUMENTS 11,359,312 B2 * 6/2022 Jones ..... D03D 15/283
11,560,681 B1 * 1/2023 Dancer ..... E02B 3/108
12,055,196 B2 * 8/2024 Bier ..... F16G 5/08
2003/0224143 A1 * 12/2003 Ianniello ..... E02D 31/02 428/137
2004/0151548 A1 * 8/2004 Hardin ..... B09B 1/006 405/129.1
2006/0029473 A1 * 2/2006 Khire ..... B09C 1/02 405/129.2
2006/0133900 A1 * 6/2006 Singleton ..... E02D 17/20 405/302.7
2006/0240733 A1 * 10/2006 Bieser ..... D04H 1/56 442/400
2007/0277897 A1 * 12/2007 King ..... D03D 15/46 139/420 R
2008/0019780 A1 * 1/2008 Hastings ..... E02D 29/0291 405/302.6
2010/0063072 A1 * 3/2010 Palle ..... C08J 7/043 544/280
2011/0206458 A1 * 8/2011 Jones ..... D03D 15/283 442/181
2011/0250809 A1 * 10/2011 King ..... D03D 15/43 442/195
2011/0262682 A1 * 10/2011 Wynn ..... D04B 21/165 428/91
2012/0020745 A1 * 1/2012 Miller ..... E02D 29/0241 405/284
2015/0159305 A1 * 6/2015 Booth ..... E02D 17/202 442/189
2016/0348333 A1 12/2016 Sutton et al.
2016/0362865 A1 * 12/2016 Segroves ..... E02D 17/202
2017/0354907 A1 * 12/2017 Ray ..... D03D 15/37
2018/0320332 A1 * 11/2018 Booth ..... D03D 13/008
2019/0145028 A1 5/2019 Jones et al.
2019/0161930 A1 * 5/2019 Cooley ..... E02B 3/126
2019/0203434 A1 * 7/2019 Segroves ..... E01F 7/02
2019/0366678 A1 * 12/2019 Jones ..... E02D 17/20
2020/0030728 A1 * 1/2020 Ray ..... D03D 15/47
2020/0354941 A1 * 11/2020 Spires ..... E03F 1/003
2021/0108436 A1 * 4/2021 Pitney ..... E04H 12/04
2022/0340997 A1 * 10/2022 Ziemkiewicz ..... C22B 59/00
2025/0243611 A1 * 7/2025 Yee ..... D03D 15/283

OTHER PUBLICATIONS

Written Opinion (WO) from International Application No. PCT/IB2025/053833; mailed on Jul. 10, 2025; 8 pages.

* cited by examiner

INTERLACED GEOTEXTILE FABRIC

TECHNICAL FIELD

The present disclosure relates to a field of geotextile fabric. More specifically, the present disclosure relates to an interlaced geotextile fabric comprising warp yarn and weft yarn interlaced with each other in a specific weave pattern.

BACKGROUND

Geotextiles represent a class of synthetic materials designed to provide various engineering functions within civil and environmental projects. These versatile textiles are manufactured from synthetic fibers, such as polyester or polypropylene, and are engineered to withstand the rigors of construction, erosion control, filtration, and drainage applications.

Unlike traditional textiles, geotextiles are specifically engineered to possess high tensile strength, durability, and resistance to environmental factors such as UV radiation, chemicals, and biological degradation. Additionally, the geotextile fabric serves as an effective barrier against the intrusion of fine particles while allowing water to pass through, facilitating drainage and preventing the buildup of hydrostatic pressure. Therefore, geotextiles are highly preferred for a wide range of applications, including road construction, embankment stabilization, landfills, coastal protection, agricultural engineering, and environmental projects.

The adoption of geotextiles has revolutionized the field of civil engineering, offering sustainable and cost-effective solutions to complex challenges by providing superior soil reinforcement, filtration, and drainage capabilities, geotextiles contribute to the longevity and stability of infrastructure while minimizing environmental impact. Moreover, in light of the rising demand for sustainable construction practices to ensure durability, efficiency, and environmental responsibility, developing suitable geotextiles is poised to play an increasingly vital role in modern engineering projects.

Geotextile, an exclusively woven web which can be an interlaced woven or non-woven web of polypropylene or polyester yarns in varied orientations, plays a crucial role in civil engineering applications. Numerous studies have demonstrated that the orientation of yarns significantly impacts the physical and mechanical properties of woven geotextiles. Geotextiles featuring appropriate yarn orientation exhibit enhanced durability, high tensile strength, and minimal elongation, making them favored choices for diverse engineering needs.

In the state of the art, there are several extensive studies on the effect of the depth, length, and vertical distance of the geotextile layers on load-bearing capability. However, despite this impressive strength profile, geotextiles often exhibit certain drawbacks. One such drawback is their tendency to have lower water flow rates. This limitation can be a significant concern in applications where efficient drainage or water permeability is essential.

When the flow rate of water through the geotextile is markedly slow, it fosters the development of an unstable soil filter cake, potentially leading to the erosion of fine soil particles and consequently compromising the overall soil stability.

Moreover, conventional geotextiles tend to feature higher Apparent Opening Size (AOS), thereby allowing relatively larger particles to pass through. However, this also implies a disadvantage that this geotextile is not effective in retaining finer soil particles or preventing erosion or soil stabilization.

Furthermore, geotextiles typically exhibit a nominal coefficient of friction with soil. While this may suffice for some applications, it may not provide the optimal level of stability required for stabilizing soft soil and retaining small soil particles.

Therefore, there is a long-felt need for developing geotextiles that offer a balanced combination of properties such as coefficient of friction, AOS, and flow rate of water to meet the requirements for stabilizing soft soil effectively, thus providing geotextiles with these desired characteristics.

SUMMARY OF THE INVENTION

This summary is provided to introduce concepts related to an interlaced geotextile fabric. This summary is not intended to identify essential features of the claimed subject matter, nor it is intended for use in determining or limiting the scope of the disclosed subject matter.

In an embodiment, an interlaced geotextile fabric is disclosed. The geotextile fabric comprising warp yarn and weft yarn interlaced with each other in a specific weave pattern making a distinctive structure that yields desirable properties of high tensile modulus, water flow, particle retention, and coefficient of friction between adjacent media and geotextile fabric.

In a related embodiment, the interlaced geotextile fabric may comprise at least one set of a warp yarn comprising a monofilament yarn. Further, the interlaced geotextile fabric may comprise at least one set of a weft yarn comprising at least one of a fibrillated tape yarn, the monofilament yarn, or a combination thereof. Further, each set of the weft yarn may be woven in the same direction/orientation at an interval.

In another embodiment, the weft yarn may comprise a first set of the weft yarn comprising the fibrillated tape yarn (and a second set of the weft yarn comprising the monofilament yarn and fibrillated tape yarn, or a combination. Further, the monofilament yarn and the fibrillated tape yarn may be selected from at least one polypropylene, polyester, polyethylene, nylon, and combination.

In another embodiment, the interlaced geotextile fabric is disclosed. The weft yarn may comprise at least one of the first set of the weft yarn comprising the fibrillated tape yarn, the second set of the weft yarn comprising the monofilament yarn and the fibrillated tape yarn, or combination.

In another embodiment, the interlaced geotextile may comprise the monofilament yarn of the warp yarn in a range of about 90-100 weight % of the total weight of the warp yarn. Further, the interlaced geotextile may comprise the fibrillated tape yarn of the first set of the weft yarn in a range of about 90-100 weight % of the total weight of the first set of the weft yarn.

In a related embodiment, the second set of the weft yarn may comprise the monofilament yarn in a range of about 1-5 weight % of the total weight of the second set of the weft yarn, and the fibrillated tape yarn in a range of about 90-100 weight % of total weight of the second set of the weft yarn.

In another embodiment, the interlaced geotextile fabric may comprise a round cross-section of the monofilament yarn of the warp yarn in a range of about 1300 to 1500 denier. Further, the interlaced geotextile fabric may comprise a rectangular cross-section and honeycomb fibrillations of the fibrillated tape yarn of the weft yarn in a range of about 5000-7000 denier and a rectangular cross-section of the monofilament yarn of the weft yarn in a range of about 600 to 800 denier.

In another embodiment, the interlaced geotextile fabric may comprise at least one of the warp yarns and the weft yarn further comprises at least one additive selected from calcium carbonate, color, Linear Low Polyethylene (LLDPE), High-Density Polyethylene (HDPE), and UV stabilizer.

In another embodiment, the interlaced geotextile fabric may comprise each set of the weft yarn interwoven with at least one set of the warp yarn such that the interlaced geotextile fabric has a twill weave pattern. Further, the interlaced geotextile fabric may have the first set of the weft yarn and the second set of the weft yarn interwoven in the same direction at an interval from fourth to tenth pick interweave, preferably eighth pick interweaves.

In another embodiment, the interlaced geotextile fabric has at least two of each first to seventh weft pick may be the first set of the weft yarn, and at least two of each fourth to tenth weft pick may be the second set of the weft yarn. Preferably, the first to fourth picks may make the first set of the weft yarn, and the fifth to eighth picks may make the second set of the weft yarn.

In another embodiment, the interlaced geotextile fabric may have each set of the weft yarn woven in floats of at least one set of the warp yarn. Furthermore, the weaving of the interlaced geotextile fabric may be extended in a direction selected from a warp direction and/or a weft direction. Furthermore, the interlaced geotextile fabric may comprise a density in the warp direction in a range of about 20 to 35 yarns/inch, and a density in the weft direction in a range of about 8 to 20 yarns/inch.

In another embodiment, the interlaced geotextile fabric may comprise a tensile strength in the warp direction in a range of about 7 to 12 kN/m at 2% elongation and in a range of about 20 to 25 KN/m at 5% elongation, and tensile strength in the weft direction in a range of about 12 to 16 kN/m at a 2% elongation and in a range of about 20 to 25 KN/m at 5% elongation. Further, the interlaced geotextile fabric may comprise a permittivity of at least 0.7-0.10 $sec^{-1}$, an opening size of at least 400-450 microns, and an interaction coefficient of at least 0.7-0.10.

BRIEF DESCRIPTION OF DRAWING

Figure 1:
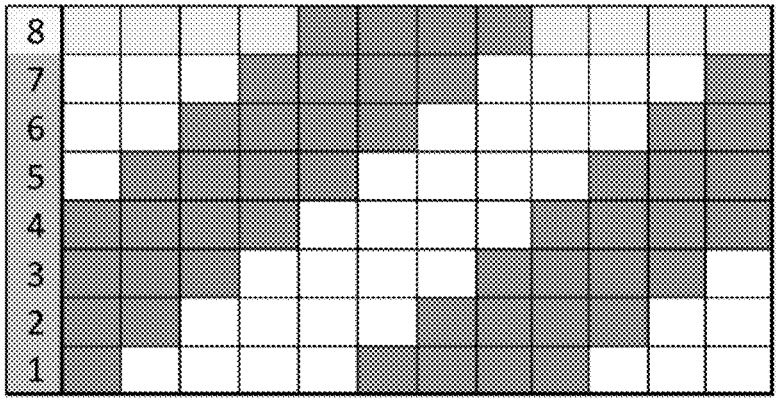

Having thus described the invention in general terms, reference will now be made to the accompanying drawings, which are not necessarily drawn to scale, and wherein:

FIG. 1 illustrates a schematic representation of an interlaced geotextile fabric in accordance with an embodiment of the present subject matter.

Figure 2:
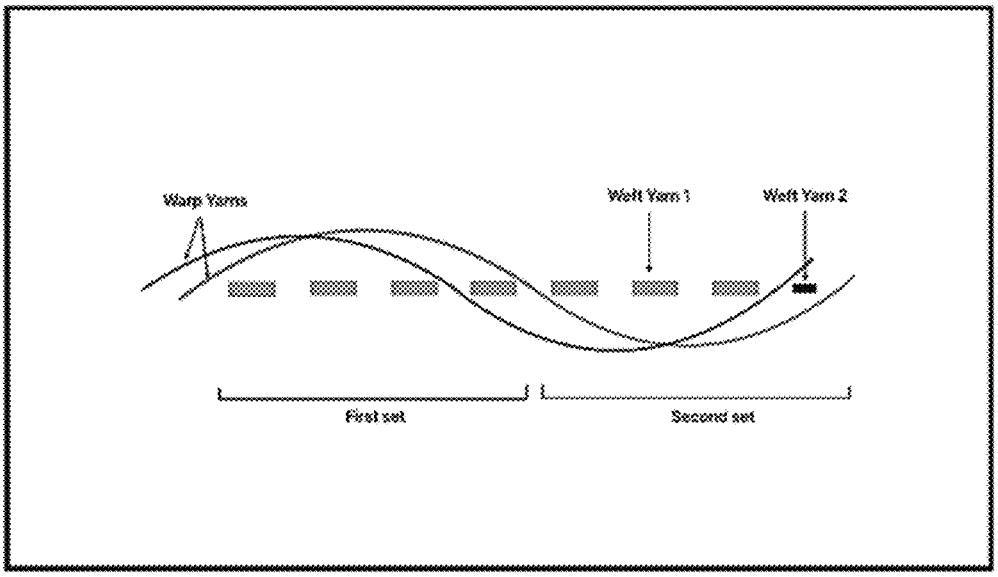

FIG. 2 illustrates a detailed depiction of the interlaced geotextile fabric in accordance with an embodiment of the present subject matter.

Figure 3:
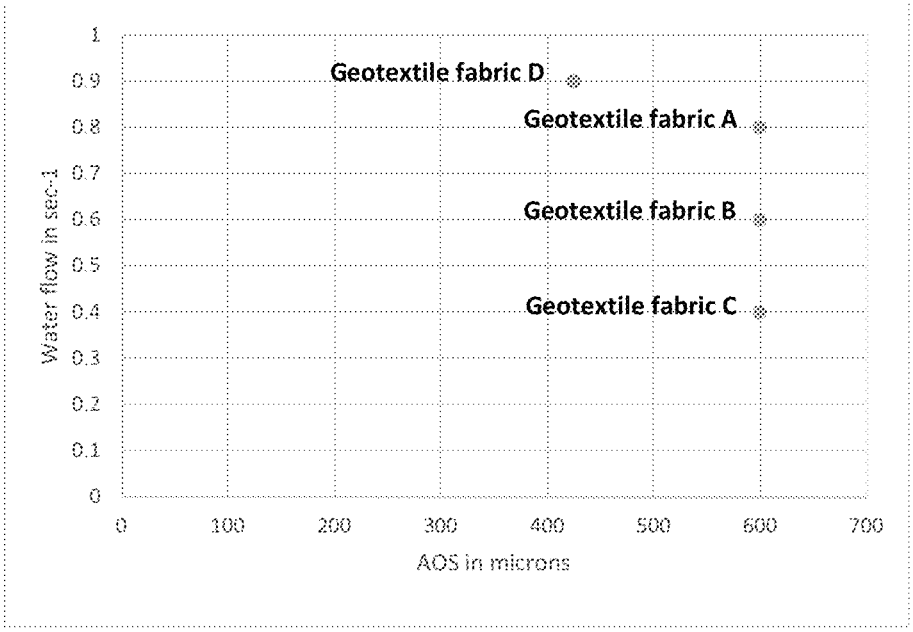

FIG. 3 illustrates a graphical representation of the impact of the interlaced geotextile fabric along with the geotextile fabric A, B, C, and D on water flow rate and apparent opening size in accordance with an embodiment of the present subject matter.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

Reference throughout the specification to "various embodiments," "some embodiments," "one embodiment," or "an embodiment" means that a particular feature, structure, or characteristic described in connection with the embodiment is included in at least one embodiment. Thus, appearances of the phrases "in various embodiments," "in some embodiments," "in one embodiment," or "in an embodiment" in places throughout the specification are not necessarily all referring to the same embodiment. Furthermore, the particular features, structures or characteristics may be combined in any suitable manner in one or more embodiments.

The words "comprising," "having," "containing," and "including," and other forms thereof, are intended to be equivalent in meaning and be open ended in that an item or items following any one of these words is not meant to be an exhaustive listing of such item or items or meant to be limited to only the listed item or items. It must also be noted that, the singular forms "a," "an," and "the" include plural references unless the context clearly dictates otherwise. Although any methods similar or equivalent to those described herein can be used in the practice or testing of embodiments of the present disclosure, exemplary methods are described. The disclosed embodiments are merely exemplary of the disclosure, which may be embodied in various forms.

Various modifications to the embodiment may be readily apparent to those skilled in the art and the generic principles herein may be applied to other embodiments. However, one of ordinary persons skilled in the art may readily recognize that the present disclosure is not intended to be limited to the embodiments illustrated but is to be accorded the widest scope consistent with the principles and features described herein. The detailed description of the invention will be described hereinafter referring to accompanied drawings.

The present disclosure relates to an interlaced geotextile fabric having better apparent opening size, permittivity, and interface friction performance, thereby providing improved hydraulic properties along with improved functionality of the fabric.

In order to facilitate an understanding of the product discussed herein, a number of terms are defined below. The terms defined below, and other terms used herein should be construed to include the provided definitions, the ordinary and customary meaning of the terms, and any other implied meaning for the respective terms. Thus, the definitions below do not limit the meaning of these terms, but only provide exemplary definitions.

The term "geotextile fabric" as used herein is a broad term and is to be given its ordinary and customary meaning to a person of ordinary skill in the art (and is not to be limited to a special or customized meaning), and refers without limitation to any permeable textile material used in conjunction with soil, rock, or other geotechnical engineering-related material.

The term "weft yarn" as used herein is a broad term and is to be given its ordinary and customary meaning to a person of ordinary skill in the art (and is not to be limited to a special or customized meaning), and furthermore refers without limitation to yarn that is woven horizontally across the width of a fabric.

Similarly, the term "warp yarn" as used herein is a broad term and is to be given its ordinary and customary meaning to a person of ordinary skill in the art (and is not to be limited to a special or customized meaning), and furthermore refers without limitation to yarn that runs lengthwise in the fabric.

Furthermore, the term "denier" as used herein is a broad term and is to be given its ordinary and customary meaning to a person of ordinary skill in the art (and is not to be limited to a special or customized meaning), and furthermore refers without limitation to the unit used in measuring the linear mass density of yarns.

The term "pick" as used herein is a broad term and is to be given its ordinary and customary meaning to a person of ordinary skill in the art (and is not to be limited to a special or customized meaning), and furthermore refers without limitation to single pass of the weft yarn over and under the warp yarn in weaving.

In an embodiment, an interlaced geotextile fabric (may be interchangeably referred to as 'geotextile', 'fabric', or 'interlaced fabric') is disclosed. This geotextile fabric may be used for various applications, including separation, filtration, drainage, reinforcement, stabilization, and protection.

The present disclosure provides a solution to the issues encountered by traditional geotextiles. The solution involves modifying factors such as weave and/or yarn density, yarn type, and weaving pattern in the geotextile fabric to enhance the tensile strength and flow behavior of geotextile fabric.

The present disclosure relates to an interlaced geotextile fabric. The geotextile fabric comprises at least one set of a warp yarn comprising a monofilament yarn. Herein, the warp yarn contributes to the structural properties and performance characteristics of the fabric, making warp yarn a key factor in various civil engineering and protection applications. Further, the monofilament yarn of the warp yarn is in a range of about 90-100 weight % of the total weight of the warp yarn.

In addition to warp yarn, the interlaced geotextile fabric comprises at least one set of a weft yarn. More preferably, the weft yarn comprises a first set of a weft yarn and a second set of a weft yarn. Here, the terms 'the first set of the weft yarn' and 'the second set of the weft yarn' do not specify a sequence and can be used interchangeably.

Several combinations of the weft yarns can be interlaced with warp yarn to attain the desirable efficiency of the weaving and the quality of the finished fabric. Herein, the interlaced geotextile fabric comprising a set of the warp yarn with two sets of the weft yarn is preferred. Furthermore, the weft yarn may comprise at least one of a fibrillated tape yarn, a monofilament yarn, or a combination.

In an alternative embodiment, the interlaced geotextile may comprise the set of the monofilament warp yarn, the first set of a weft yarn comprising the fibrillated tape yarn (interchangeably referred to as 'weft yarn 1'), and the second set of the weft yarn comprising the monofilament yarn (interchangeably referred to as 'weft yarn 2').

In an alternative embodiment, the interlaced geotextile may comprise the set of the monofilament warp yarn, the first set of the weft yarn comprising the monofilament yarn, and the second set of the weft yarn comprising the fibrillated tape yarn.

In an alternative embodiment, the interlaced geotextile may comprise one set of the monofilament warp yarn, a first set of the weft yarn comprising the monofilament yarn, and a second set of the weft yarn comprising a combination of fibrillated tape yarn and monofilament yarn.

In a preferred embodiment, the interlaced geotextile further may comprise the set of the monofilament warp yarn, the first set of the weft yarn comprising the fibrillated tape yarn (weft yarn 1), and the second set of the weft yarn comprising a combination of the fibrillated tape yarn (weft yarn 1) and the monofilament yarn (weft yarn 2) in a ratio of 1-4:1, more preferably 3:1.

Herein, two sets of the weft yarn are preferred in the geotextile fabric as two distinct types of weft yarns facilitate a porous structure that yields high flow rates and low AOS. Additionally, the physical difference in size and texture of these two yarns makes a distinct porous structure when set in a specific repetition and yields desired low AOS values with high permittivity.

Herein, each set of the weft yarn is interwoven with at least one set of the warp yarn to obtain the interlaced geotextile fabric. The interlaced geotextile fabric may be interwoven into several types of patterns which include but are not limited to a twill weave, plain weave, satin weave and, more preferably twill weave.

The twill weave is a fundamental textile weave distinguished by its characteristic diagonal rib pattern, which enhances the strength and flexibility of fabrics. Unlike plain weaves, where the warp yarn and weft yarn cross each other alternately, twill weave involves a staggered over-and-under pattern, resulting in a distinct diagonal texture. The specific pattern of over-and-under passes can vary, leading to different types of twill weaves such as 1×1, 2×2, 3×3, 4×4, and others.

In the present disclosure, a 4×4 twill weave is preferred with a repeat of 4 warp and 4 weft threads. These twill weaves can be woven in variations which include regular, unbalanced, reverse, or double twill In an embodiment, the unbalanced 4×4 twill is preferred which includes the weave being uneven and unbalanced, with a pattern that is not limited to a 3 over and 1 under pattern, or vice versa, or a 4 over and 4 under pattern, or vice versa. The unbalanced twill creates a more pronounced diagonal line and results in a fabric that can have different textures or thicknesses on each side. Thus, the twill pattern of the interlaced geotextile significantly impacts the performance and properties such as coefficient of friction, AOS, and flow rate of water of the geotextile fabric.

In another embodiment, the monofilament yarn of the warp yarn is in a range of about 90-100 weight % of the total weight of the warp yarn. Whereas the monofilament yarn of the weft yarn, specifically the second set of the weft yarn, is in a range of about 1-5 weight % of the total weight of the second set of the weft yarn.

In a related embodiment, the fibrillated tape yarn of the first set of the weft yarn is in a range of about 90-100 weight % of the total weight of the first set of the weft yarn. Likewise, the fibrillated tape yarn of the second set of the weft yarn is in a range of about 90-98 weight % of the total weight of the second set of the weft yarn.

In another embodiment, the monofilament yarn and fibrillated tape yarn are selected from at least one polypropylene, polyester, polyethylene, nylon, and combinations thereof. More preferably, the monofilament yarn and fibrillated tape yarn are polypropylene (PP) yarn.

Herein, PP fibrillated yarns are preferably selected as they facilitate resistance to environmental factors such as UV radiation, chemicals, and biological degradation. Additionally, the PP fibrillated yarns are opted out as a geotextile material to yield a high tensile modulus and facilitate a higher rate of water flow through the manufactured fabric.

Similarly, the monofilament yarn is made up of PP for the same inherent properties and additionally to impart a porous structure to the geotextile fabric which facilitates a high-water flow rate at low apparent opening sizes. Thus, polypropylene as the choice of material for weft yarns uplifts the geotextile's resistance to chemical and environmental degradation, UV resistance, and overall durability. Furthermore, the warp yarn and weft yarn comprise 90-95 wt. % polypropylene of the total weight of the yarn.

In a preferred embodiment, the interlaced geotextile fabric comprises at least one set of warp yarn comprising the polypropylene monofilament tape yarn, the first set of a weft yarn comprising the polypropylene fibrillated tape yarn, and a second set of a weft yarn comprising a combination of polypropylene fibrillated tape yarn and polypropylene monofilament yarn in a ratio of 3:1.

In addition to polypropylene, the warp yarn and the weft yarn of the interlaced geotextile fabric may further comprise at least one additive selected from calcium carbonate, coloring component, linear low-density polyethylene (LLDPE), high-density polyethylene (HDPE), and UV stabilizer. The additives are added in weight percent in the range of 4 to 10% of the total weight of the fabric admixture.

In one aspect of the disclosure, the warp yarn and second set of the weft yarn may comprise a composition of the coloring component, high-density polyethylene (HDPE) in the range of 2-4%, and UV stabilizer in the range of 1-2%, more preferably in the range of 1.2%. Similarly, the first set of the weft yarn may comprise a composition of calcium carbonate and linear low-density polyethylene (LLDPE) in a range of 1-2%, coloring component in a range of 3-5%, and UV stabilizer in a range of 0.1-0.5%. Herein, the LLDPE aids in increasing the processability and strength of the yarn.

In a different aspect of the disclosure, the first set of the weft yarn and the second set of the weft yarn do not incorporate any LLDPE and HDPE additives.

Moreover, each set of the weft yarn is woven in floats of the warp yarn. More particularly, the weft yarns are woven in floats of the warp yarns and these floats can either be up or down relative to the weft position creating an interlaced fabric structure.

These alternate floats in the fabric comprise the first set of the weft yarn containing polypropylene fibrillated tape yarn and the second set of the weft yarn containing a mix of polypropylene monofilament yarn and polypropylene fibrillated tape yarn makes a unique ribbed fabric surface. Consequently, the interlaced geotextile fabric exhibits an exceptional interaction coefficient with soil, emphasizing its efficacy in relevant applications due to its ribbed surface structure.

The direction of weaving in the fabric includes warp direction and weft direction. Different machines and apparatus are employed to weave the fabric in a machine direction or cross-machine direction.

Furthermore, a set of the weft yarn is woven in the same direction at an interval. Herein, the interval defines a pattern of weaving the multiple sets of the weft yarn. More preferably, the interval defines a pattern of weaving the two sets of the weft yarn in the interlaced geotextile.

In another embodiment, the first set of the weft yarn and the second set of the weft yarn are interwoven in the same direction at an interval from fourth to tenth pick interweaves. More preferably, the first set of the weft yarn and the second set of the weft yarn are interwoven in the same direction at an interval of 8 pick interweaves.

In a related embodiment, the geotextile fabric having at least two of each first to seventh weft pick is the first set of weft yarn, and at least one of each fourth to tenth weft pick is the second set of weft yarn. A ratio of weft pick of the first set of weft yarn to the second set of weft yarn is 1:1. The first set of the weft yarn is fibrillated tape weft yarn, and the second set of the weft yarn is a combination of $\frac{3}{4}^{th}$ fibrillated tape yarn and $\frac{1}{4}^{th}$ monofilament yarn.

In a related embodiment, the geotextile fabric having at least two of each first to seventh weft pick is the first set of weft yarn, and at least one of each fourth to tenth weft pick is the second set of weft yarn. Specifically, a first to fourth weft pick is the first set of weft yarn and every fifth to eighth weft pick is the second set of the weft yarn. More specifically, a first to fourth weft pick is the first set of fibrillated tape weft yarn and every fifth to eighth weft pick is the second set of the weft yarn comprising a combination of $\frac{3}{4}^{th}$ fibrillated tape yarn and $\frac{1}{4}^{th}$ monofilament yarn.

Referring to FIG. 2, a detailed schematic view of the interlaced geotextile fabric is illustrated. The geotextile fabric preferably comprises picks 1-4 representing the first set of the weft yarn and picks 4-8 representing the second set of weft yarns. Also, it can be noted that pick 1-4 of the first set of the weft yarn and pick 5-7 of the second set of the weft yarn is fibrillated tape yarn and pick 8 of the second set of the weft yarn is monofilament yarn.

In another embodiment, the interlaced yarn comprises a round cross-section of the monofilament yarn of the warp yarn in a range of about 1300-1500 denier, and more preferably 1350 to 1450 denier. Similarly, the interlaced yarn comprises a rectangular cross-section, and honeycomb fibrillations of the fibrillated tape yarn of the weft yarn are in a range of about 5000-7000 denier.

In a related embodiment, the interlaced geotextile fabric comprising a rectangular cross-section of the monofilament yarn of the weft yarn is in the range of about 600 to 800 denier, more preferably 650-750 denier.

In another embodiment, the interlaced geotextile fabric comprises a density in the warp direction in a range of about 20 to 35 yarns/inch, more preferably 30 yarns/inch, and a density in the weft direction in a range of about 8 to 20 yarns/inch, more preferably 10-15 yarns/inch, more preferably, 14 yarns/inch.

The distinct physical characteristics, size, density, and denier disparity between the first set of the weft yarn and the second set of the weft yarn, coupled with their special arrangement within the fabric, create a unique porous fabric structure. This structure enables significant water flow rates and enhances particle retention. Thus, the interlaced geotextile fabric prepared as per the present disclosure demonstrates several improved properties such as water flow rate and interaction coefficient.

The following examples of the various embodiments may reveal a deeper understanding of the various properties of the interlaced geotextile fabric:

COMPARATIVE EXAMPLE 1: GEOTEXTILE FABRIC A

Monofilament Warp Yarn

Blending 93.4% polypropylene, 3% HDPE, 2.4% color, and 1.2% UV additives to obtain the monofilament warp yarn.

Fibrillated Tape Weft Yarn

Blending 93.64% polypropylene, 1.87% calcium carbonate as filler, 4.11% color, and 0.38% UV additives to obtain a fibrillated weft yarn. Interweaving a monofilament warp yarn with one set of fibrillated tape weft yarn to obtain geotextile fabric A. The weave pattern of the geotextile fabric A has a repeat of 2 picks.

COMPARATIVE EXAMPLE 2: GEOTEXTILE FABRIC B

The warp yarns and weft yarns for the comparative example 2 were prepared following the same procedure as outlined in Example 1. However, a variation in the weave pattern was introduced to assess the impact on the final properties of the material. The weave pattern of the geotextile fabric B has a repeat of 4 picks.

COMPARATIVE EXAMPLE 3: GEOTEXTILE FABRIC C

The warp yarns and weft yarns for the comparative example 3 were prepared following the same procedure as outlined in Example 1. However, a variation in the weave pattern was introduced to assess the impact on the final properties of the material. The weave pattern of the geotextile fabric C has a regular twill weave pattern with a repeat of 8 picks.

EXAMPLE 4: INTERLACED GEOTEXTILE FABRIC (GEOTEXTILE FABRIC D)

Warp Yarn

Adding 92.8% of polypropylene monofilament yarn with a round cross-section having a denier range of 1350-1450, followed by the addition of color additive and high-density polyethylene (HDPE) in the range of 3%. Further, adding UV stabilizer in the range of 1.2% to obtain a warp yarn. The warp yarn facilitates strength of 6.2 g/denier at 10% elongation.

Weft Yarn 1

Adding 92% of polypropylene fibrillated tape yarn with rectangular cross-section and honeycomb fibrillations having a denier range of 5000-7000, followed by the addition of color additive in the range of 4% and Linear low-density polyethylene (LLDPE) and calcium carbonate in the range of 1.8%. Further, adding a UV stabilizer in the range of 0.4% to obtain a weft yarn 1. The weft yarn 1 facilitates a strength of 5 g/denier at 10% elongation.

Weft Yarn 2

Adding 93.5% of polypropylene monofilament yarn with a rectangular cross-section having a denier range of 600-900, followed by the addition of color additive in the range of 2.3% and HDPE in the range of 3%. Further, adding a UV stabilizer in the range of 1.2% to obtain a weft yarn 2. The weft yarn 2 facilitates a strength of 7 g/denier at 18% elongation.

The obtained warp yarn is interlaced with the obtained weft yarn 1 and weft yarn 2 in a twill weave pattern to obtain interlaced geotextile fabric as discussed in FIGS. 1 & 2. The obtained interlaced geotextile fabric herein is referred to as geotextile fabric D.

Referring to pattern in FIGS. 1 and 2, an unbalanced twill weave pattern of the warp yarn and weft yarn in the interlaced geotextile fabric is illustrated. The number 1 to 8 denotes each weft yarn in a repeat of the weave design of the fabric, wherein picks 1 to 7 are of fibrillated tape weft yarn and every eighth pick is of monofilament weft yarn. Further, picks 1-4 represent the first set of weft yarns, and picks 5-8 represent the second set of weft yarns. Also, it can be noted that pick 5-7 in the second set of the weft yarn is polypropylene-based fibrillated tape yarn whereas pick 8 is polypropylene-based monofilament.

Further, the geotextile fabric D was analyzed to characterize the properties of the fabric. On testing, it was noted that geotextile fabric D comprises high strength yarns and exhibits a tensile strength of at least 9 kN/m at 2% elongation and at least 24 kN/m at 5% elongation in the warp direction. In the weft direction, the strength values are at least 15 kN/m at 2% elongation and at least 24 kN/m at 5% elongation, wherein the testing was conducted in accordance with ASTM 4595D.

For hydraulic properties, the fabric demonstrates a permittivity of at least 0.9 $sec^{-1}$ according to ASTM 4491. The Apparent Opening Size (AOS) is measured at a minimum of 425 microns using ASTM 4751. The interaction coefficient of the fabric is verified to be at least 0.9, as per the standards outlined in ASTM 6706.

EXAMPLE 5: INTERLACED GEOTEXTILE FABRIC (GEOTEXTILE FABRIC E)

The polypropylene-based monofilament warp yarn is interlaced with the polypropylene-based fibrillated tape weft yarn 1 and polypropylene-based monofilament weft yarn 2 in a twill weave pattern to obtain geotextile fabric E.

Warp Yarn

Adding 92.8% of polypropylene monofilament yarn with a round cross-section having a denier range of 1350-1450, followed by the addition of color additive and high-density polyethylene (HDPE) in the range of 3%. Further, adding UV stabilizer in the range of 1.2% to obtain a warp yarn. The warp yarn facilitates strength of 6.2 g/denier at 10% elongation.

Weft Yarn 1

Blending 93.64% polypropylene, 1.87% calcium carbonate as filler, 4.11% color, and 0.38% UV additives to obtain a fibrillated weft yarn.

Weft Yarn 2

Adding 93.5% of polypropylene monofilament yarn with a rectangular cross-section having a denier range of 5000-7000, followed by the addition of color additive in the range of 2.3% and HDPE in the range of 3%. Further, adding a UV stabilizer in the range of 1.2% to obtain a weft yarn 2. The weft yarn 2 facilitates a strength of 7 g/denier at 18% elongation.

Further, the properties such as tensile strength, coefficient of interaction, water flow rate, and apparent opening size of the geotextile fabrics A, B, C, D, and E obtained by examples 1, 2, 3, 4 and 5 respectively were compared (results provided in table 1).

TABLE 1

Comparison of the interlaced geotextile fabric with existing geotextile fabric

| | Geotextile fabric A | Geotextile fabric B | Geotextile fabric C | Geotextile fabric D | Geotextile fabric E |
|---|---|---|---|---|---|
| Warp yarn and weft yarn density (number of yarns per inch or picks per inch) | 21 × 8 | 30 × 9.7 | 30 × 13.2 | 30 × 12.7 | 30 × 13.7 |

TABLE 1-continued

Comparison of the interlaced geotextile fabric with existing geotextile fabric

| | Geotextile fabric A | Geotextile fabric B | Geotextile fabric C | Geotextile fabric D | Geotextile fabric E |
|---|---|---|---|---|---|
| Dimensions of yarn (warp × weft) | 0.95 mm × 13 mm | 0.90 mm × 13 mm | 1.1 mm × 13 mm | 0.50 mm × 7 mm in width/ 0.80 mm in diameter | 0.50 mm × 7 mm in width/ 0.80 mm in diameter |
| Tensile Strength at 2% elongation (MD AND XMD) | 7 KN/m × 8.6 KN/m | 10.5 KN/ ×15 KN/m | 14 KN/m × 21.9 KN/m | 8.8 KN/m × 14.9 KN/m | 8.8 KN/m × 14.9 KN/m |
| Tensile Strength at 5% elongation (MD AND XMD) | 38 KN/m × 36 KN/m | 22 KN/m × 23 KN/m | 35 KN/m × 44 KN/m | 26 KN/m × 33 KN/m | 26 KN/m × 33 KN/m |
| Water flow rate in $sec^{-1}$ | 0.60 | 0.80 | 0.40 | 0.90 | 0.90 |
| AOS in micron | 600 | 600 | 600 | 425 | 425 |
| Coefficient of interaction | — | — | — | >.90 | >.90 |
| Weave design | 1 × 1 | 3 × 1 | 4 × 4 | 4 × 4 | 4 × 4 |
| Weave pattern | Plain | Twill | Regular twill | Unbalanced twill | Unbalanced twill |
| Interval | 2 picks | 4 picks | 8 picks | 8 picks | 8 picks |

*Herein, mD: machine direction (lengthwise); XMD: cross-machine direction (horizontal lengthwise)

Thus, the table highlights the enhanced properties of the geotextile fabric D and E as compared to comparative Examples of geotextile fabrics A, B & C. Thus, it can be concluded that the geotextile fabric D and E comprising a warp yarn, and two types of weft yarns (weft yarn 1, and weft yarn 2) have better pore sizes of less than 425 microns and high-yielding permittivity greater than 0.9 $sec^{-1}$.

Based on the data presented in FIG. 3, it is evident that geotextile fabric D demonstrates enhanced flow rates even at lower Apparent Opening Size (AOS) when compared to geotextile fabrics A, B, and C.

Additionally, it is worth noting that geotextile fabric E exhibits comparable results to geotextile fabric D, suggesting that construction is the critical attribute that is helping us to achieve hydraulic properties. Thus, the enhanced properties are the result of a synergistic effect stemming from one or more components such as weaving pattern, type of weft yarn, denier, and density of yarn, rather than the presence of additives.

Thus, it can be concluded that attributing factors such as the usage of two sets of the weft yarn and the arrangement of every eighth pick being of different type and dimensions of the weft yarn along with the weave pattern of unbalanced twill contributes to the improved soil retention and high-yielding permittivity.

The improved properties achieved by the claimed interlaced geotextile fabric include, Elevate the fabric's overall tensile strength, reinforcing its durability and robustness.

Better coefficient of friction when in contact with soil.

High water flow and particle retention coupled with excellent interaction coefficient.

High-yielding permittivity

This claimed interlaced geotextile fabric on application in roadway construction and ground stabilization offers reinforcement, stabilization, separation, and drainage performance when used on soft soil. The primary intended use of the geotextile fabric is for the stabilization of soft soil; however, its applications are not limited to this specific purpose.

The invention claimed is:

1. An interlaced geotextile fabric, comprises:

at least one set of a warp yarn comprising a monofilament yarn; and at least one set of a weft yarn comprising at least one of a fibrillated tape yarn, the monofilament yarn, or a combination thereof, wherein each set of the weft yarn is woven in a same direction at an interval, wherein the fabric has a permittivity of at least 0.7-0.9 $sec^{-1}$;

an opening size of at least 400-450 microns; and an interaction coefficient of at least 0.7-1.0.

2. The interlaced geotextile fabric as claimed in claim 1, wherein at least one set of the weft yarn, comprises:

a first set of the weft yarn comprising the fibrillated tape yarn;

a second set of the weft yarn comprising the monofilament yarn and fibrillated tape yarn; or a combination.

3. The interlaced geotextile fabric as claimed in claim 1, wherein the monofilament yarn and the fibrillated tape yarn are selected from at least one polypropylene, polyester, polyethylene, nylon, and combination.

4. The interlaced geotextile fabric as claimed in claim 1, wherein the monofilament yarn of the warp yarn is in a range of about 90-100 weight % of total weight of the warp yarn.

5. The interlaced geotextile fabric as claimed in claim 2, wherein the fibrillated tape yarn of the first set of the weft yarn is in a range of about 90-100 weight % of total weight of the first set of the weft yarn.

6. The interlaced geotextile fabric as claimed in claim 2, wherein the second set of the weft yarn comprises, the monofilament yarn in a range of about 1-5 weight % of total weight of the second set of the weft yarn; and the fibrillated tape yarn in a range of about 90-98 weight % of total weight of the second set of the weft yarn.

7. The interlaced geotextile fabric as claimed in claim 1, wherein a round cross-section of the monofilament yarn of the warp yarn is in a range of about 1300 to 1500 denier.

8. The interlaced geotextile fabric as claimed in claim 1, wherein the fibrillated tape yarn of the weft yarn has a rectangular cross-section and honeycomb fibrillations, and wherein the fibrillated tape yarn has a linear density in a range of about 5000-7000 denier.

9. The interlaced geotextile fabric as claimed in claim 1, wherein the monofilament yarn of the weft yarn has a rectangular cross-section, and wherein the monofilament yarn has a linear density in a range of about 600 to 800 denier.

10. The interlaced geotextile fabric as claimed in claim 1, wherein at least one of the warp yarn and the weft yarn further comprises at least one additive selected from calcium carbonate, color, linear low density polyethylene (LLDPE), high density polyethylene (HDPE), and UV stabilizer.

11. The interlaced geotextile fabric as claimed in claim 1, wherein each set of the weft yarn is interwoven with the at least one set of the warp yarn such that the interlaced geotextile fabric has a twill weave pattern.

12. The interlaced geotextile fabric as claimed in claim 1, wherein the first set of the weft yarn and the second set of the weft yarn are interwoven in same direction at an interval from fourth to tenth pick interweave.

13. The interlaced geotextile fabric as claimed in claim 1, wherein the first set of the weft yarn and the second set of the weft yarn are interwoven in same direction at an interval from an eighth pick interweave.

14. The interlaced geotextile fabric as claimed in claim 12, wherein at least two of each first to seventh weft pick are the first set of the weft yarn, and at least two of each fourth to tenth weft pick is the second set of the weft yarn.

15. The interlaced geotextile fabric as claimed in claim 13, wherein the first to fourth picks are the first set of the weft yarn, and the fifth to eighth picks are from the second set of the weft yarn.

16. The interlaced geotextile fabric as claimed in claim 1, wherein each set of the weft yarn is woven in floats of the at least one set of the warp yarn.

17. The interlaced geotextile fabric as claimed in claim 1, wherein weaving of the fabric is extended in a direction selected from a warp direction and/or a weft direction.

18. The interlaced geotextile fabric as claimed in claim 1, has a warp yarn density in the warp direction is in a range of about 20 to 35 yarns/inch; and wherein a weft yarn density in the weft direction is in a range of about 8 to 20 yarns/inch.

19. The interlaced geotextile fabric as claimed in claim 1, comprises:

a tensile strength in the warp direction is in a range of about 7 to 12 kN/m at 2% elongation and in a range of about 20 to 25 kN/m at 5% elongation; and a tensile strength in the weft direction is in a range of about 12 to 16 kN/m at a 2% elongation and in a range of about 20 to 25 kN/m at 5% elongation.

* * * * *